US010340631B1

(12) United States Patent
Hung et al.

(10) Patent No.: US 10,340,631 B1
(45) Date of Patent: Jul. 2, 2019

(54) COUPLING STRUCTURE OF CABLE CONNECTOR

(71) Applicants: KUNSHAN AMPHENOL ZHENGRI ELECTRONICS CO., LTD., Kunshan, Jiangsu Province (CN); Amphenol LTW Technology Co., Ltd., New Taipei (TW)

(72) Inventors: Jen-Yuan Hung, New Taipei (TW); Chih-Wen Hu, New Taipei (TW); Kun-Te Ko, New Taipei (TW)

(73) Assignees: KUNSHAN AMPHENOL ZHENGRI ELECTRONICS CO., LTD., Kunshan, Jiangsu Province (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/105,287

(22) Filed: Aug. 20, 2018

(30) Foreign Application Priority Data

Jun. 15, 2018 (TW) ..... 107120746 A

(51) Int. Cl.
*H01R 13/622* (2006.01)
*H01R 13/631* (2006.01)

(52) U.S. Cl.
CPC ..... *H01R 13/622* (2013.01); *H01R 13/631* (2013.01)

(58) Field of Classification Search
CPC ..... H01R 13/633–635; H01R 13/631
USPC ..... 439/180, 253–257
See application file for complete search history.

(56) References Cited

U.S. PATENT DOCUMENTS 3,452,316 A * 6/1969 Mocek ..... H01R 13/637 439/255
4,138,181 A 2/1979 Hacker et al.
4,208,082 A * 6/1980 Davies ..... H01R 13/6277 439/155

(Continued)

FOREIGN PATENT DOCUMENTS

EP 0157542 A2 10/1985

OTHER PUBLICATIONS

Search Report dated Mar. 4, 2019 of the corresponding European patent application.

*Primary Examiner* — Gary F Paumen
(74) *Attorney, Agent, or Firm* — Chun-Ming Shih; HDLS IPR Services

(57) ABSTRACT

A coupling structure of a cable connector includes a first connection head and a second connection head. The first connection head includes a first joint part, multiple insertion terminals, and an external threaded portion disposed on the first joint part. The second connection head includes a second joint part, multiple insertion holes, a fastening sleeve, a socket formed between the fastening sleeve and the second joint part, a positioning ring receiving the fastening sleeve, a plurality of fastening elements arranged between the positioning ring and the fastening sleeve, and a quick-release fastening ring. The quick-release fastening ring rotatably presses on the fastening elements. An internal threaded portion of each fastening element is engaged with the external threaded portion. Therefore, the first connection head and the second connection head can be securely fastened to each other and can be quickly detached from each other.

12 Claims, 9 Drawing Sheets

(56) References Cited

U.S. PATENT DOCUMENTS

| | | | | |
|---|---|---|---|---|
| 4,279,458 | A * | 7/1981 | Knapp | H01R 13/622 285/316 |
| 4,620,760 | A * | 11/1986 | Duncan | H01R 13/622 439/153 |
| 5,653,605 | A | 8/1997 | Woehl et al. | |
| 6,461,179 | B1 * | 10/2002 | Sullivan | H01R 13/6277 439/253 |
| 7,364,450 | B2 * | 4/2008 | Hafner | H01R 13/622 439/253 |
| 7,850,472 | B2 * | 12/2010 | Friedrich | H01R 13/506 439/256 |
| 7,972,158 | B2 * | 7/2011 | Wild | H01R 13/6277 439/257 |
| 8,187,014 | B2 * | 5/2012 | Laughlin | H01R 13/633 439/180 |
| 9,705,248 | B1 | 7/2017 | Ko | |
| 2004/0175977 | A1 * | 9/2004 | Eaton | H01R 13/633 439/180 |
| 2005/0250365 | A1 | 11/2005 | Starke et al. | |
| 2010/0294117 | A1 * | 11/2010 | Laughlin | H01R 13/6277 89/1.58 |

* cited by examiner

COUPLING STRUCTURE OF CABLE CONNECTOR

TECHNICAL FIELD

The present invention relates to a connector coupling structure, and in particular, to a coupling structure of a cable connector for delivering power or transmitting electrical signals.

BACKGROUND

In a conventional cable connector, a first connection head having a plurality of first cables is coupled to a second connection head having a plurality of second cables to deliver power and/or transmit electrical signals. In order to prevent the first and second connection heads of the cable connector from being inadvertently detached from each other to cause power outage or to interrupt electrical signal transmission. The first connection head and the second connection head need to be securely fastened to each other by means of, for example, an insertion connection method, a rotational coupling method, or a threaded fastening method.

However, among the above methods, although the insertion connection method allows for quick detachment, this method cannot ensure a secure connection, especially under an external pulling force or vibrations. On the other hand, the rotational coupling method or the threaded fastening method can ensure a reliable connection, but cannot allow for quick detachment, which causes inconvenience in use.

In view of this, the inventor studied various technologies and created an effective solution in the present disclosure.

SUMMARY

It is an objective of the present invention to provide a coupling structure of a cable connector, which allows for secure fastening and quick detachment.

Accordingly, the present invention provides a coupling structure of a cable connector. The coupling structure includes a first connection head and a second connection head. The first connection head includes a first joint part, a plurality of insertion terminals disposed in the first joint part, and an external threaded portion formed on an outer peripheral surface of the first joint part. The second connection head includes a second joint part, a plurality of insertion holes disposed in the second joint part, a fastening sleeve surroundingly disposed outside the second joint part, a socket formed between the fastening sleeve and the second joint part, a positioning ring receiving the fastening sleeve, a plurality of fastening elements arranged spaced apart from each other between the positioning ring and the fastening sleeve, and a quick-release fastening ring detachably receiving the fastening sleeve. The first joint part is inserted into the socket, the insertion terminals are correspondingly inserted into the respective insertion holes, the quick-release fastening ring rotatably presses on the fastening elements, and an internal threaded portion of each fastening element is engaged with the external threaded portion of the first joint part.

According to one embodiment, a plurality of pressing portions spaced apart from each other protrude from an inner surface of the quick-release fastening ring. The fastening elements are disposed corresponding to the pressing portions respectively. Each fastening element has an inclined surface and a protruding portion connected to the inclined surface.

Each pressing portion is rotated to press from each inclined surface onto each protruding portion. The fastening sleeve includes a plurality of fastening holes for accommodating the fastening elements respectively. The positioning ring includes two connection strips to limit movement of the fastening elements and includes a plurality of connection plates connected to the connection strips, so that each fastening element is limited to move in each fastening hole, and thereby each pressing portion can press on each protruding portion.

When the first connection head and the second connection head are electrically coupled to each other, a user can rotate the quick-release fastening ring by an angle (in a clockwise direction for example), so that each pressing portion presses on the protruding portion of each fastening element, an internal threaded portion of each fastening element is thereby engaged with the external threaded portion of the first joint part, and the first joint part and the second joint part are securely fastened to each other. It should be noted that, when the quick-release fastening ring is rotated, a stopper is moved across the protruding resilient plate and abuts against the same, thereby preventing the quick-release fastening ring from rotating reversely to be separated from the fastening elements to cause detachment of the first joint part from the second joint part.

In one embodiment, when it is desired to detach the first connection head from the second connection head, the user only needs to rotate the quick-release fastening ring reversely (i.e. in a counterclockwise direction), then the internal threaded portion of each fastening element can be disengaged from the external threaded portion of the first connection head, and thereby the first connection head is rapidly detached from the second connection head.

In another embodiment of the present invention, the quick-release fastening ring includes at least one hook engaged with the flange, an accommodating space formed between the flange and the pressing portions, and a resilient element received in the accommodating space. The quick-release fastening ring is movable toward a second rod with respect to the fastening sleeve. When the quick-release fastening ring is moved toward the flange to compress the resilient element, each pressing portion of the quick-release fastening ring is rapidly separated from the protruding portion of each fastening element, so that the internal threaded portion is disengaged from the external threaded portion, and thereby the first connection head can be detached from the second connection head to achieve a quick release/detachment effect.

The present invention further has the following advantages. When the first connection head and the second connection head are coupled to each other, each pressing portion can effectively press on the protruding portion of each fastening element to provide a stable fastening effect. To detach the first connection head from the second connection head, the user can either rotate the quick-release fastening ring or horizontally move the quick-release fastening ring to achieve quick detachment of the first connection head from the second connection head.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
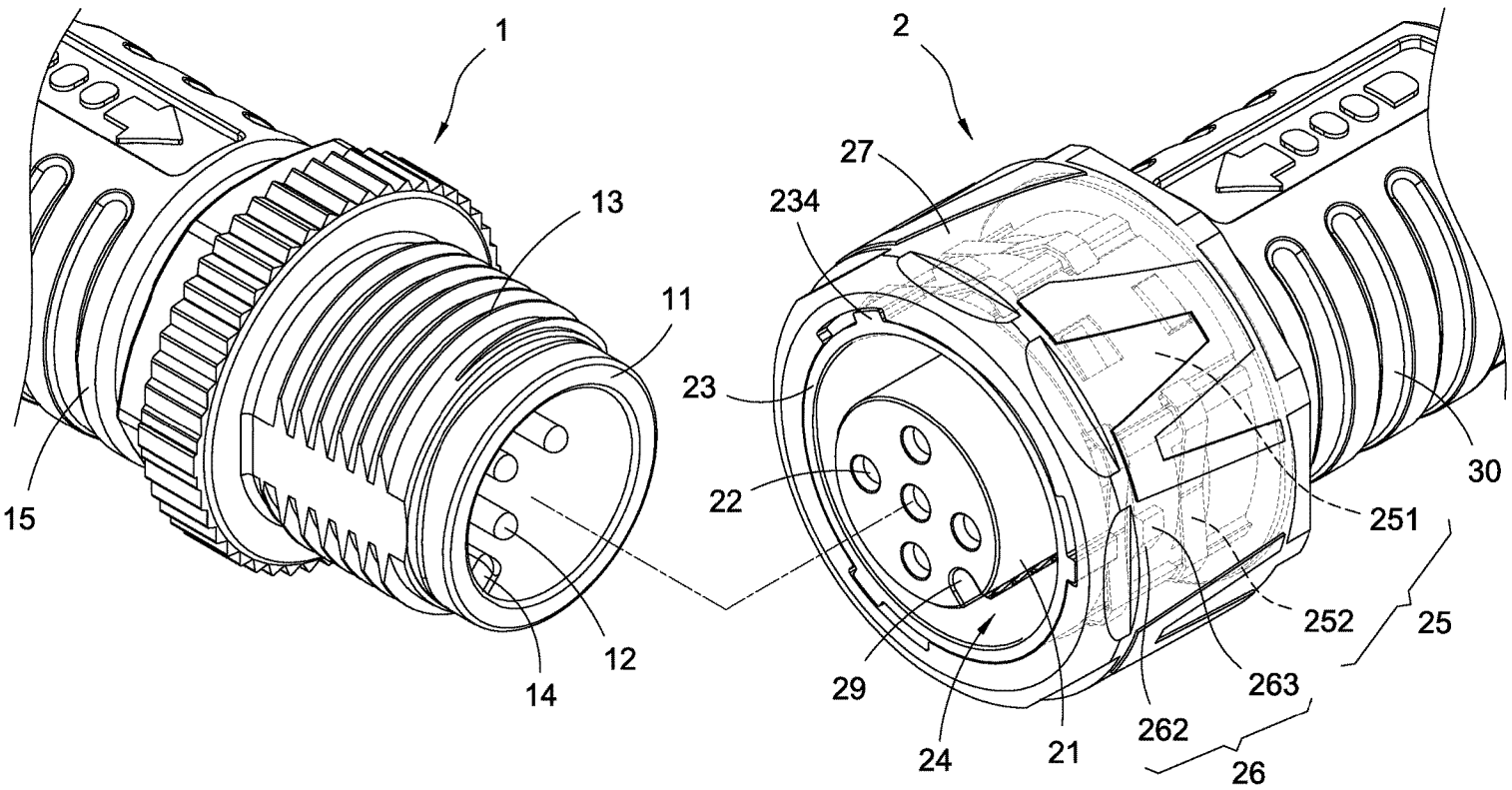
FIG. 1 is a perspective view of the present invention, illustrating a coupling structure of a cable connector before coupling assembly.
Figure 2:
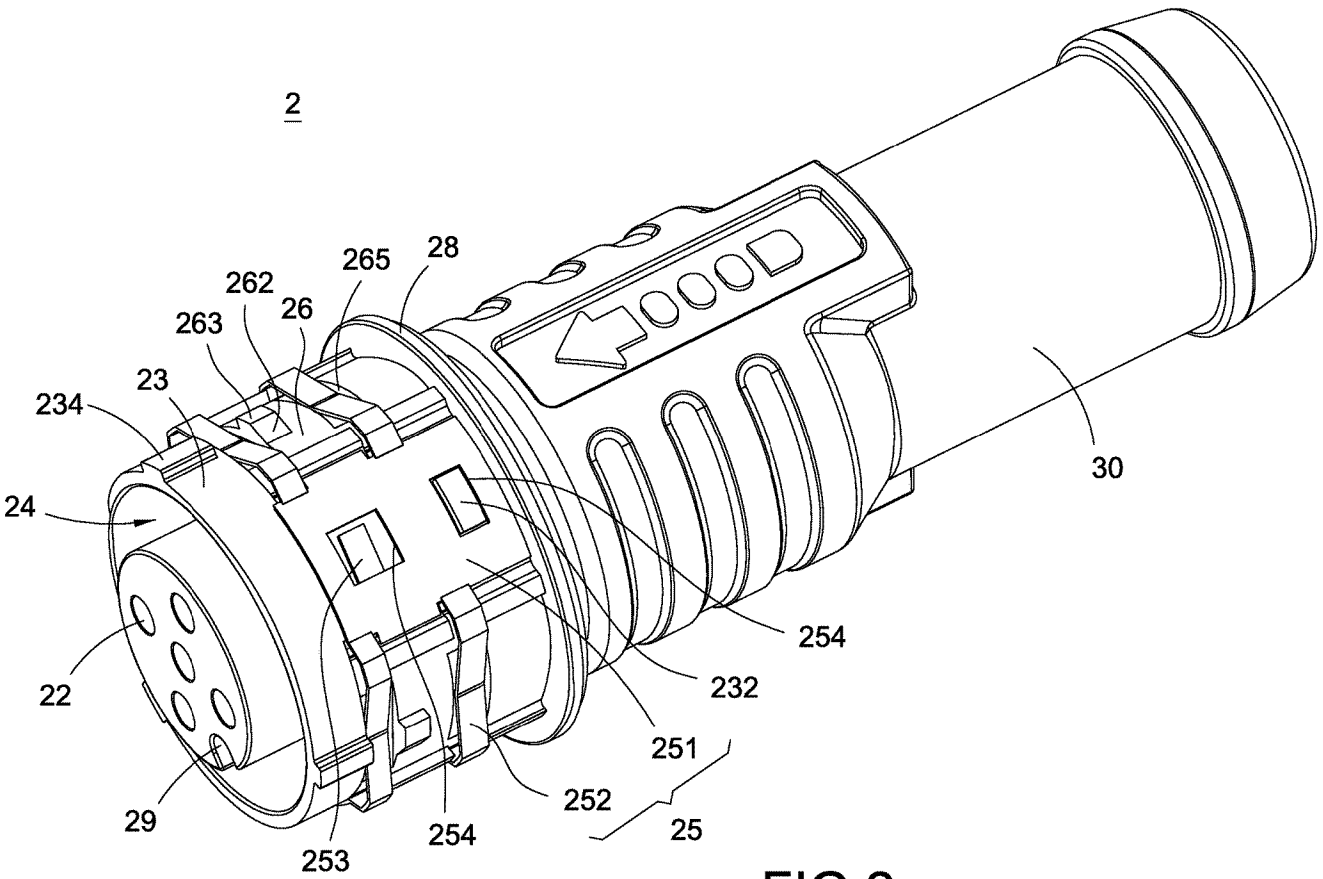
FIG. 2 is a perspective view illustrating that a positioning ring of a first connection head receives a fastening sleeve (with omission of the quick-release fastening ring)
Figure 3:
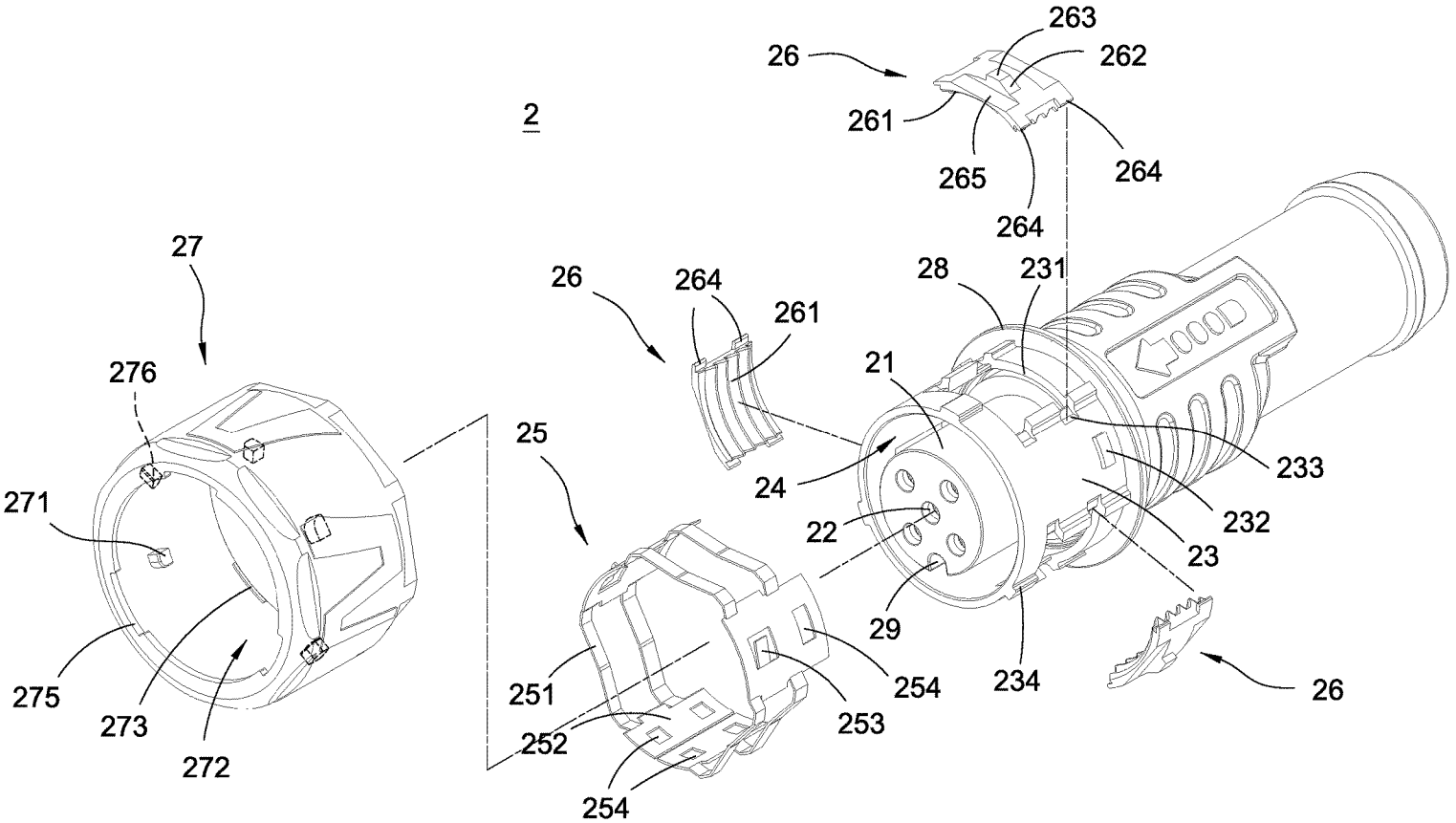
FIG. 3 is a perspective exploded view illustrating the first connection head in the coupling structure of the cable connector.
Figure 4:
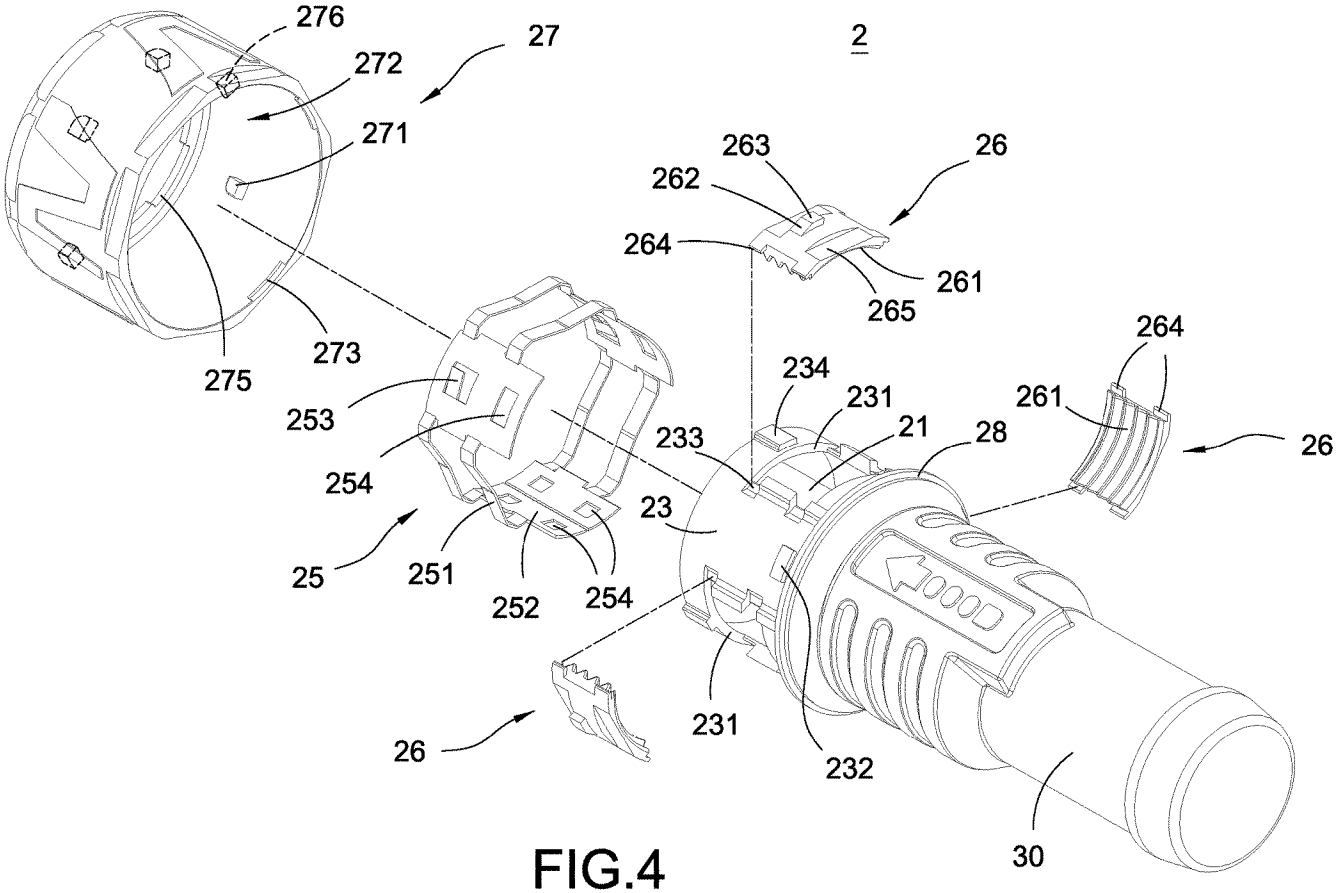
FIG. 4 is a perspective exploded view, taken from another viewing angle, illustrating the first connection head in the coupling structure of the cable connector.

Detailed descriptions and technical contents of the present disclosure are illustrated below in conjunction with the accompanying drawings. However, it is to be understood that the descriptions and the accompanying drawings disclosed herein are merely illustrative and exemplary and not intended to limit the scope of the present disclosure.

Please refer to FIGS. 1 to 4 showing a coupling structure of a cable connector. The coupling structure includes a first connection head 1 and a second connection head 2. In the coupling structure, the first connection head 1 and the second connection head 2 connect at least one cable (not illustrated) and are electrically connected to each other so as to deliver power and/or transmit signals. However, the first connection head 1 and the second connection head 2 can also be used in a pneumatic connector field or other different fields; the present invention is not limited in this regard.

The first connection head 1 includes a first joint part 11, a plurality of insertion terminals 12 disposed in the first joint part 11, and an external threaded portion 13 formed on an outer peripheral surface of the first joint part 11. The second connection head 2 includes a second joint part 21, a plurality of insertion holes 22 disposed in the second joint part 21, a fastening sleeve 23 surroundingly disposed outside the second joint part 21, a socket 24 formed between the fastening sleeve 23 and the second joint part 21, a positioning ring 25 receiving the fastening sleeve 23, a plurality of fastening elements 26 arranged spaced apart from each other between the positioning ring 25 and the fastening sleeve 23, and a quick-release fastening ring 27 detachably fastening the fastening elements 26.

When the first connection head 1 and the second connection head 2 are coupled to each other, the first joint part 11 is inserted into the socket 24, and the insertion terminals 12 are correspondingly inserted into the respective insertion holes 22. A guide block 14 arranged adjacent to the insertion terminals 12 is disposed on an inner surface of the first joint part 11. The second joint part 21 includes a guide slot 29 disposed corresponding to the guide block 14, so that the first joint part 11 can be inserted into the second joint part 21 in a predetermined direction, thus preventing wrong insertion.

In the present embodiment, the first connection head 1 further includes a first rod 15 connected to the first joint part 11, and the second connection head 2 includes a second rod 30 connected to the second joint part 21. The first rod 15 and the second rod 30 are of cylindrical shape. A protruding pattern (not labelled) is formed on a portion of a surface of the second rod 30 for easy gripping by a user. At least one cable is disposed inside each of the first rod 15 and the second rod 30, the cables are connected or detached from each other by making the first joint part 11 and the second joint part 21 connected or detached from each other, so as to deliver power or interrupt signal transmission.

In the embodiment shown in FIGS. 1 to 4, a plurality of pressing portions 271 spaced apart from each other and at least one stopper 276 are arranged protruding from an inner surface of the quick-release fastening ring 27. The stopper 276 is disposed between two of the pressing portions 271. The fastening elements 26 are disposed corresponding to the pressing portions 271 respectively, and each fastening element 26 has an inclined surface 262 and a protruding portion 263 connected to the inclined surface 262. Each pressing portion 271 of the quick-release fastening ring 27 is rotated to press from each inclined surface 262 to each protruding portion 263, so that an internal threaded portion 261 of each fastening element 26 is pressed to be engaged with the external threaded portion 13 of the first joint part 11, and thereby the first connection head 1 and the second connection head 2 are securely fastened to each other.

In the present embodiment, each pressing portion 271, each stopper 276 and each protruding portion 263 are a protruding block, a lump, or of other suitable shape for providing pressing or blocking effects. The quick-release fastening ring 27 is hollow and has a through hole 272. The quick-release fastening ring 27 receives the fastening ring 23. Before the quick-release fastening ring 27 is assembled to the fastening sleeve 23, the positioning ring 25 receives the fastening sleeve 23.

The fastening sleeve 23 includes a plurality of fastening holes 231 for accommodating the fastening elements 26 respectively. The positioning ring 25 includes two connection strips 251 to limit axial movement (left-to-right movement) of each fastening element 26 and includes a plurality of connection plates 252 connected to the connection strips 251. Each fastening element 26 is movable in a radial direction (up-to-down direction) between the connection strips 251 and the socket 24. Each connection plate 252 includes at least one protruding resilient plate 253 and at least one positioning hole 254. The stopper 276 is rotated to abut against the protruding resilient plate 253 to prevent reverse rotation of the quick-release fastening ring 27.

The fastening sleeve 23 includes a positioning block 232 disposed corresponding to the positioning hole 254, so that the positioning block 232 is protrudingly engaged with the positioning hole 254, and the positioning ring 25 is positioned on an outer peripheral surface of the fastening sleeve 23. Two sheet portions 264 protrude from two side edges of each fastening element 26 respectively along a direction of the connection strips 251. The fastening sleeve 23 includes two recesses 233 arranged corresponding to the two sheet portions 264 respectively, so that when each fastening element 26 is moved in a radial direction with respect to each fastening hole 231, the fastening elements 26 can be aligned with the respective recesses 233 and restored to its original position.

In the present embodiment, there are preferably three fastening elements 26 and three fastening holes 231. Each fastening element 26 is preferably an arc-shaped plate so as to engage the external threaded portion 13 of the first joint part 11. Each fastening element 26 includes two cut grooves 265 disposed corresponding to the two connection strips 251 respectively, so that each fastening element 26 can move with respect to the respective fastening hole 231 in an accurate and reliable manner. The positioning ring 25 formed by pressing or bending can effectively limit radial and axial movement of the fastening elements 26 in the respective fastening holes 231, so that the pressing portions 271 of the quick-release fastening ring 27 are rotated to press the respective protruding portion 263 in an accurate, reliable, fast and efficient manner.

Figure 6:
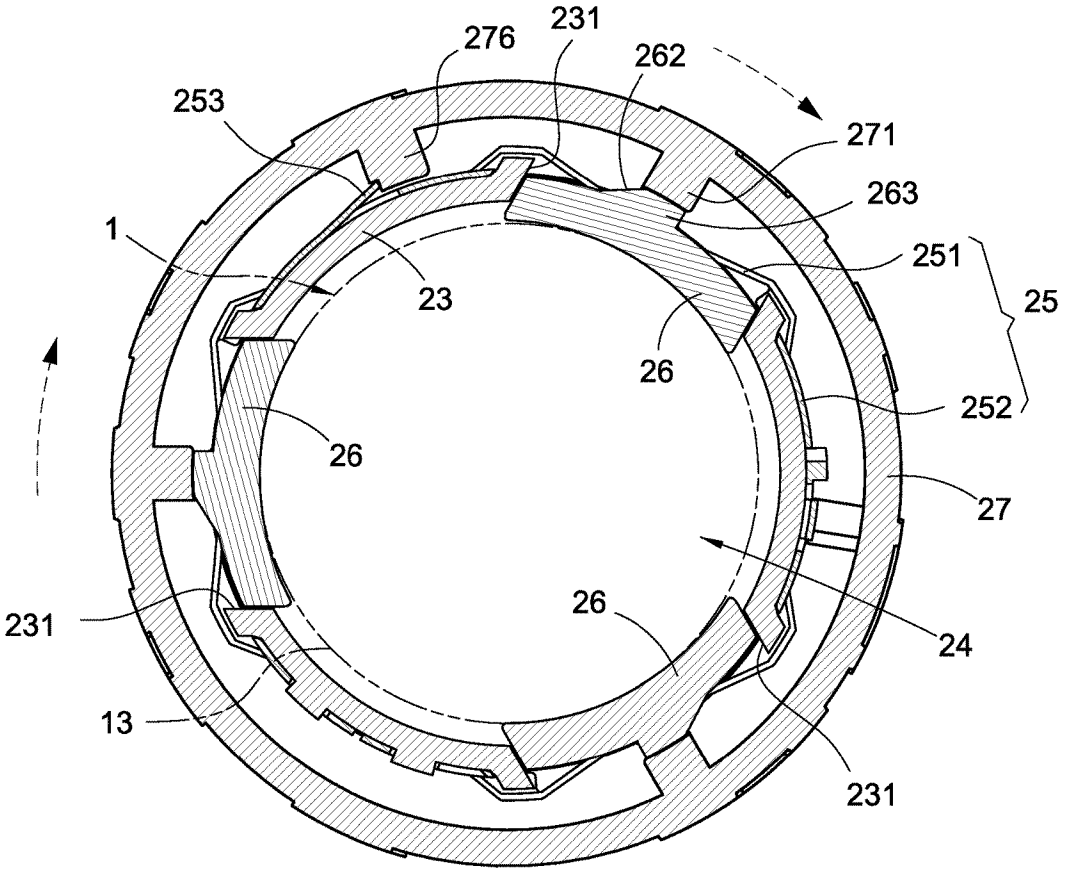
FIG. 6 is a cross-sectional view illustrating that the quick-release ring is rotated to press the fastening element.
Figure 7:
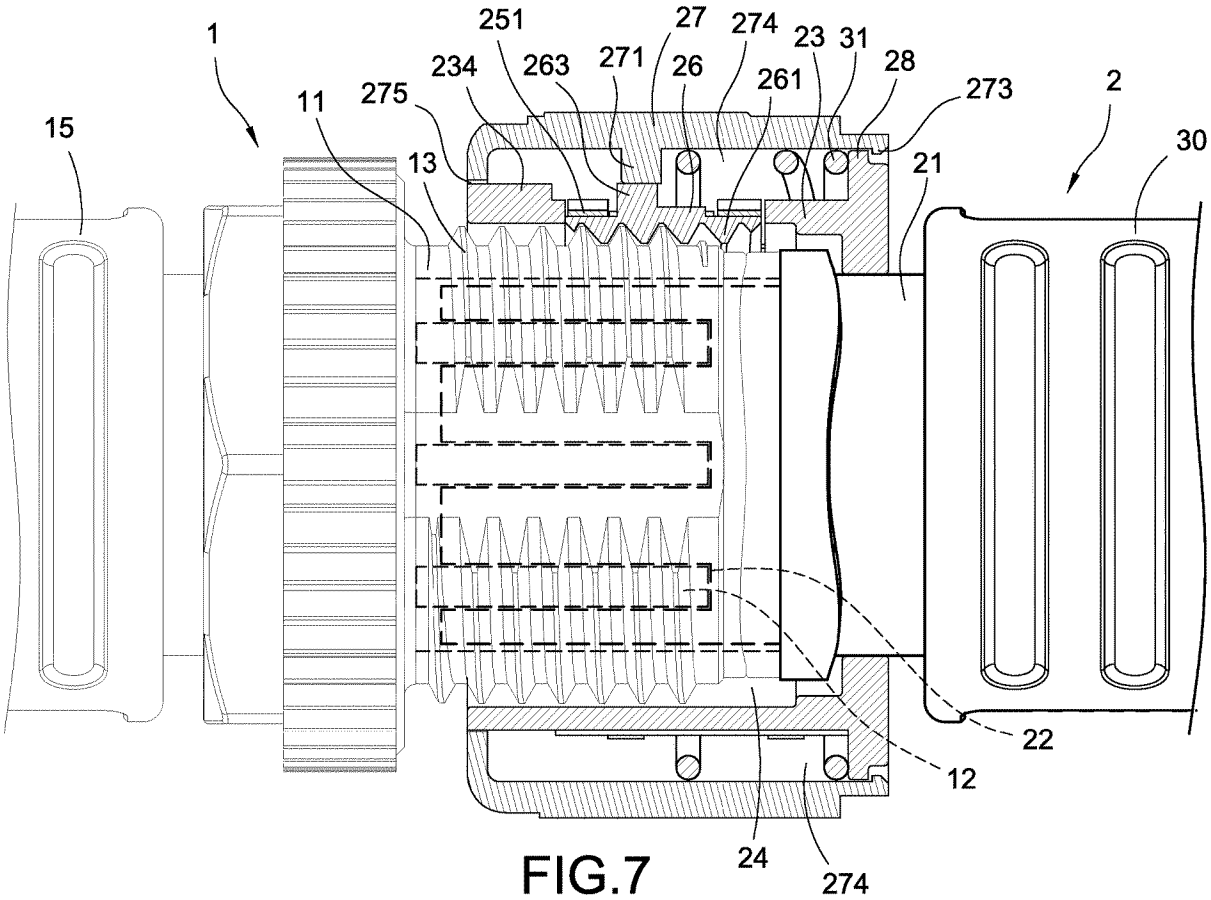
FIG. 7 is a cross-sectional view, taken from another viewing angle, illustrating that the quick-release fastening ring is rotated to press the fastening element, so that a second connection head is securely threadedly fastened to the first connection head.

Referring to FIGS. 6 and 7, the second connection head 2 further includes a flange 28 perpendicularly connected to the fastening sleeve 23. The quick-release fastening ring 27 includes at least one hook 273 engaged with the flange 28 and includes an accommodating space 274 formed between the flange 28 and the pressing portions 271. The hook 273 blocks movement of the quick-release fastening ring 27 in a direction toward the first connection head 1. A plurality of limitation blocks 234 disposed spaced apart from each other protrude from a peripheral end portion of the fastening sleeve 23. The limitation blocks 234 are arranged in an axial direction corresponding to the respective fastening holes 231 so as to limit a rotation angle of the quick-release fastening ring 27.

The quick-release fastening ring 27 forms a plurality of breaches 275 disposed corresponding to the limitation blocks 234 respectively. Each breach 275 is larger than a size of each limitation block 234, thereby limiting the rotation angle of the quick-release fastening ring 27. In the present embodiment, the rotation angle of the quick-release fastening ring 27 is in a range from 60 to 90 degrees. Each limitation blocks 234 are arranged corresponding to the center of each fastening hole 231. In other words, each limitation blocks 234 are arranged corresponding to the protruding portion of each fastening element 26.

Figure 5:
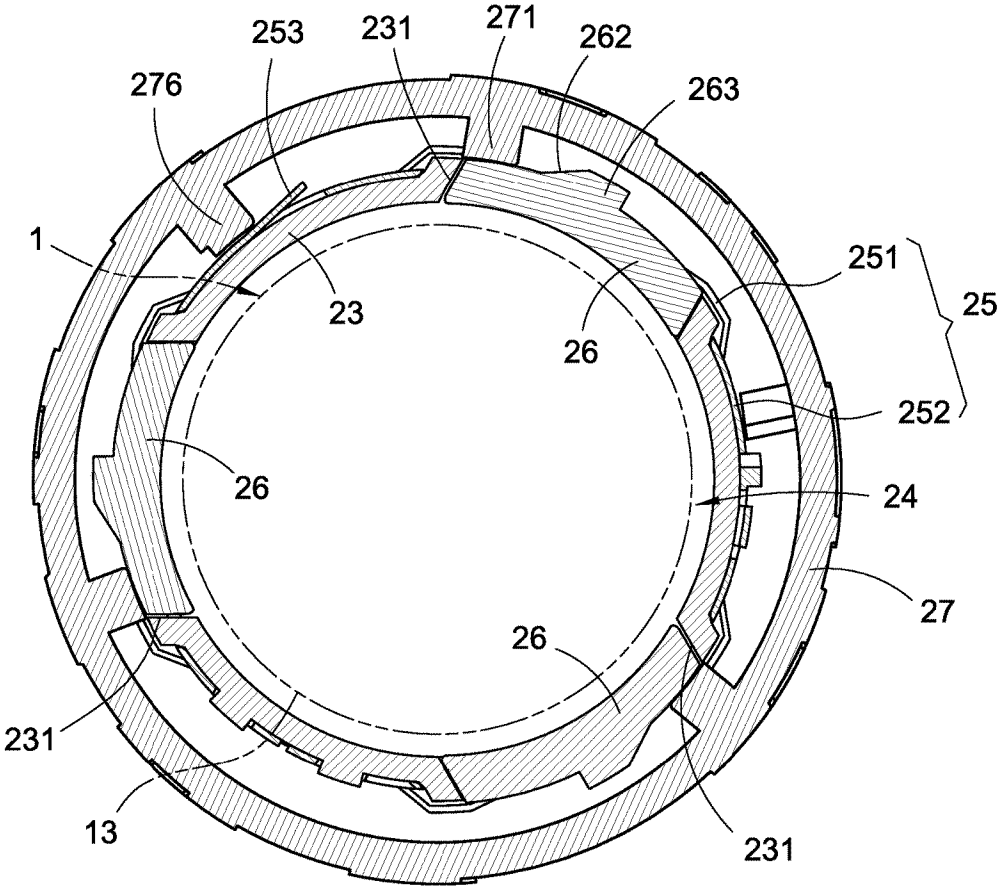
FIG. 5 is a cross-sectional view illustrating the quick-release fastening ring before it presses down the fastening element.

Rapid detachment operations of the coupling structure of the present invention are further detailed below. As shown in FIGS. 5 to 7, when the first connection head 1 and the second connection head 2 are electrically coupled to each other, the user can rotate the quick-release fastening ring 27 by an angle (in a clockwise direction for example), so that each pressing portion 271 presses on the protruding portion 263 of each fastening element 26, and an internal threaded portion 261 of each fastening element 26 is engaged with the external threaded portion 13 of the first joint part 11. Accordingly, the first joint part 11 and the second joint part 21 are securely fastened to each other. It should be noted that, when the quick-release fastening ring 27 is rotated, the stopper 276 is moved across the protruding resilient plate 253 and abuts against the same, thereby preventing the quick-release fastening ring 27 from rotating reversely to be separated from the fastening elements 26 to cause detachment of the first joint part 11 from the second joint part 21.

Figure 8:
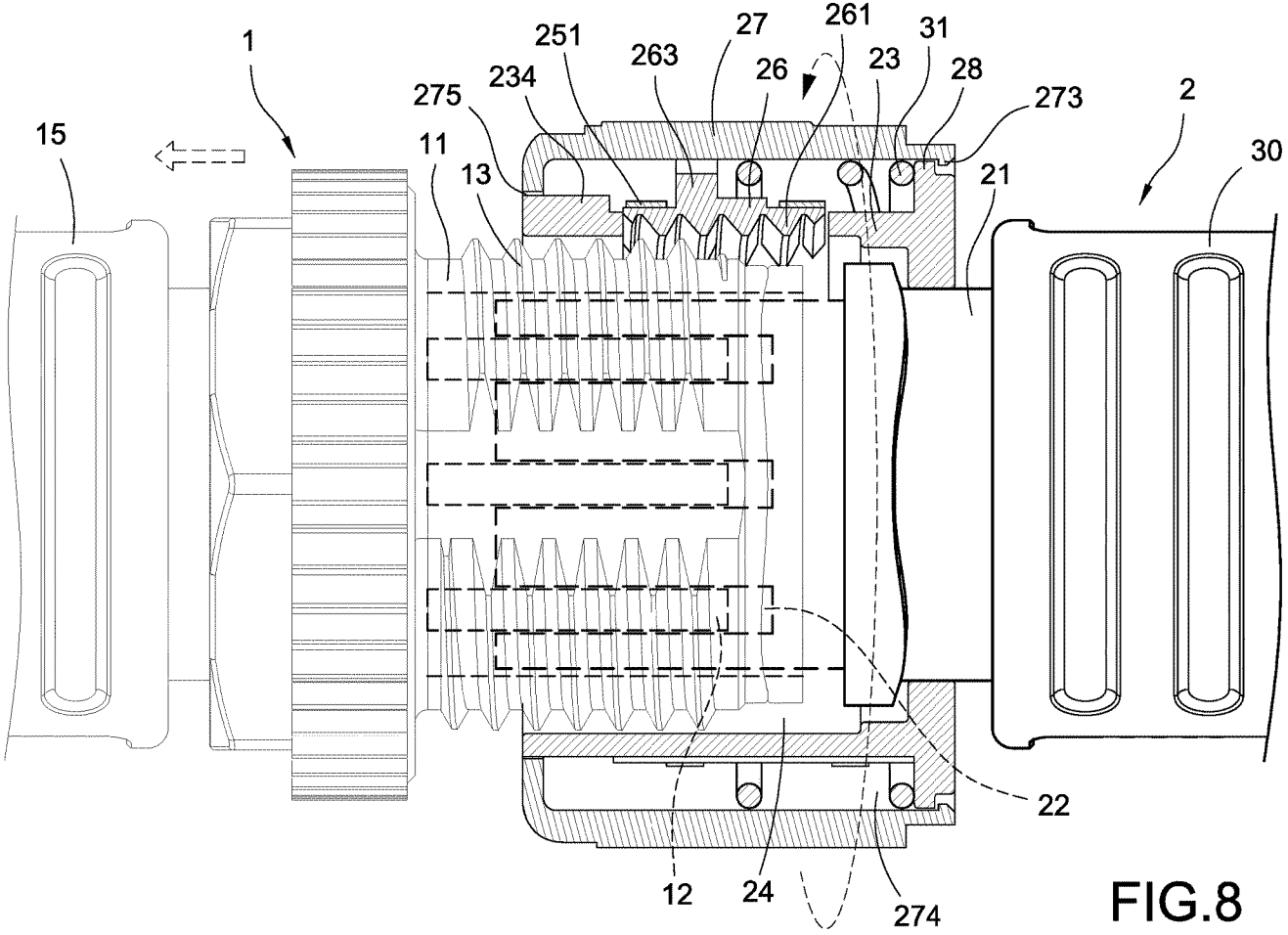
FIG. 8 is a cross-sectional view illustrating that the quick-release fastening ring is rotated to be separated from the fastening element.

Referring to FIG. 8, when it is desired to detach the first connection head 1 from the second connection head 2, the user only needs to rotate the quick-release fastening ring 27 reversely (i.e. in a counterclockwise direction), then the internal threaded portion 261 of each fastening element 26 can be disengaged from the external threaded portion 13 of the first connection head 1, and thereby the first connection head 1 is detached from the second connection head 2. By using the positioning ring 25, the movement of the fastening elements 26 is limited to facilitate the user's performing fastening operations next time.

Figure 9:
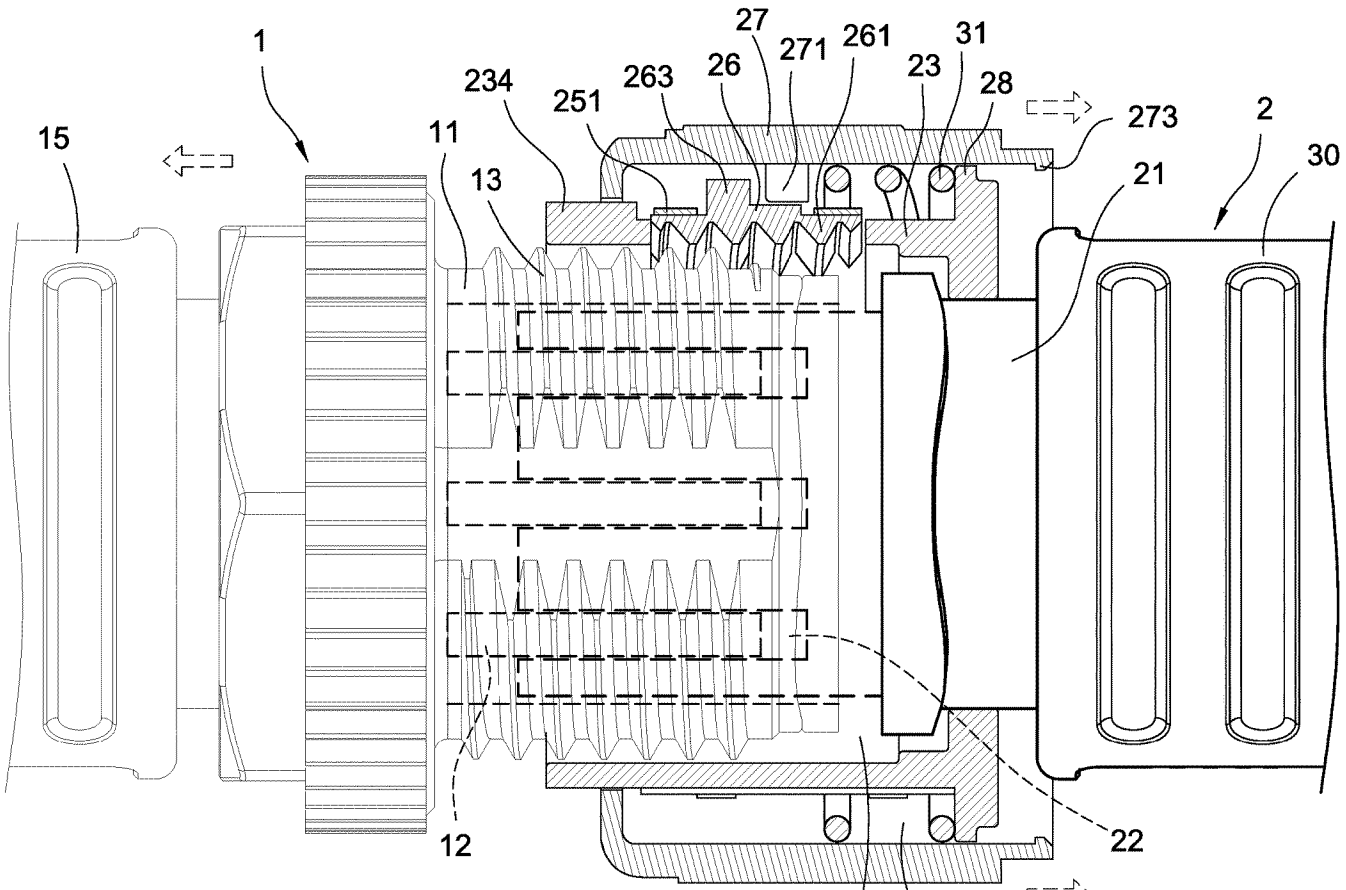
FIG. 9 is a cross-sectional view illustrating that the quick-release fastening ring is horizontally moved with respect to the fastening sleeve to be separated from the fastening element.

Please refer to FIG. 9, illustrating another quick-release operation method. The present embodiment includes a resilient element 31 received in the accommodating space 274. The resilient element 31 is preferably a compression spring or other suitable elastic element. When the quick-release fastening ring 27 is moved toward the flange 28 (i.e. toward the second rod 30) to compress the resilient element 31, each pressing portion 271 of the quick-release fastening ring 27 is separated from the protruding portion 263 of each fastening element 26, and the internal threaded portion 261 of each fastening element 26 is disengaged from the external threaded portion 13, so that the first connection head 1 is detached from the second connection head 2 to thereby achieve quick release/detachment. When the user releases the quick-release fastening ring 27, the resilient element 31 provides a resilient force to restore the quick-release fastening ring 27 to its original position, as shown in FIG. 8.

As a result, when the first connection head 1 and the second connection head 2 are coupled to each other, each pressing portion 271 of the quick-release fastening ring 27 can effectively press the protruding portion 263 of each fastening element 26, so as to achieve a secure fastening/engagement effect. By rotating the quick-release fastening ring 27 or by moving the quick-release fastening ring 27 horizontally, the first connection head 1 and the second connection head 2 can be detached from each other.

It is to be understood that the above descriptions are merely the preferable embodiments of the present disclosure and are not intended to limit the scope of the present disclosure. Equivalent changes and modifications made in the spirit of the present disclosure are regarded as falling within the scope of the present disclosure.

What is claimed is:

1. A coupling structure of a cable connector, comprising:

a first connection head (1) including a first joint part (11), a plurality of insertion terminals (12) disposed in the first joint part (11), and an external threaded portion (13) formed on an outer peripheral surface of the first joint part (11); and a second connection head (2) including a second joint part (21), a plurality of insertion holes (22) disposed in the second joint part (21), a fastening sleeve (23) surroundingly disposed outside the second joint part (21), a socket (24) formed between the fastening sleeve (23) and the second joint part (21), a positioning ring (25) receiving the fastening sleeve (23), a plurality of fastening elements (26) arranged spaced apart from each other between the positioning ring (25) and the fastening sleeve (23), and a quick-release fastening ring (27) detachably fastening the fastening elements (26), wherein the first joint part (11) is inserted into the socket (24), the insertion terminals (12) are correspondingly inserted into the respective insertion holes (22), the quick-release fastening ring (27) rotatably presses on the fastening elements (26), and an internal threaded portion (261) of each fastening element (26) is engaged with the external threaded portion (13) of the first joint part (11).

2. The coupling structure of the cable connector according to claim 1, wherein a plurality of pressing portions (271) spaced apart from each other protrude from an inner surface of the quick-release fastening ring (27), the fastening elements (26) are disposed corresponding to the pressing portions (271) respectively, each fastening element (26) includes an inclined surface (262) and a protruding portion (263) connected to the inclined surface (262), and each pressing portion (271) is rotated to press from each inclined surface (262) onto each protruding portion (263).

3. The coupling structure of the cable connector according to claim 2, wherein the fastening sleeve (23) includes a plurality of fastening holes (231) for accommodating the fastening elements (26) respectively, and the positioning ring (25) includes two connection strips (251) to limit movement of each fastening element (26) and includes a plurality of connection plates (252) connected to the connection strips (251).

4. The coupling structure of the cable connector according to claim 3, wherein each of the connection plates (252) has a protruding resilient plate (253) and at least one positioning hole (254), the inner surface of the quick-release fastening ring (27) is disposed with a stopper (276) near the pressing portion (271), the stopper (276) blocks the protruding resilient plate (253) to limit a rotation direction of the quick-release fastening ring (27), and the fastening sleeve (23) includes a positioning block (232) disposed corresponding to the positioning hole (254) to position the positioning ring (25).

5. The coupling structure of the cable connector according to claim 3, wherein two sheet portions (264) protrude from two side edges of each fastening element (26) respectively along a direction of each connection strip (251), and the fastening sleeve (23) includes two recesses (233) arranged corresponding to the two sheet portions (264) respectively.

6. The coupling structure of the cable connector according to claim 3, wherein each fastening element (26) is an arc-shaped plate, and each fastening element (26) includes two cut grooves (265) disposed corresponding to the two connection strips (251) respectively.

7. The coupling structure of the cable connector according to claim 1, wherein the second connection head (2) further includes a flange (28) perpendicularly connected to the fastening sleeve (23), the quick-release fastening ring (27) includes a plurality of pressing portions (271) disposed spaced apart from each other, at least one hook (273) engaged with the flange (28), and an accommodating space (274) formed between the flange (28) and the pressing portions (271).

8. The coupling structure of the cable connector according to claim 7, wherein a plurality of limitation blocks (234) protrude from an end portion of the fastening sleeve (23) and are disposed spaced apart from each other, each limitation block (234) is disposed at one end of the fastening sleeve (23) opposite to the flange (28), and the quick-release fastening ring (27) forms a plurality of breaches (275) disposed corresponding to the limitation blocks (234) respectively.

9. The coupling structure of the cable connector according to claim 7, further comprising a resilient element (31) received in the accommodating space (274), wherein the resilient element (31) provides a resilient force to restore the quick-release fastening ring (27) to its original position.

10. The coupling structure of the cable connector according to claim 8, wherein a size of each breach (275) is larger than a size of each limitation block (234).

11. The coupling structure of the cable connector according to claim 1, wherein the first joint part (11) further includes a guide block (14) disposed adjacent to the insertion terminals (12), and the second joint part (21) includes a guide slot (29) disposed corresponding to the guide block (14), so that the first joint part (11) can be inserted into the second joint part (21) in a predetermined direction.

12. The coupling structure of the cable connector according to claim 1, wherein the first connection head (1) further includes a first rod (15) connected to the first joint part (11), and the second connection head (2) includes a second rod (30) connected to the second joint part (21).

* * * * *